United States Patent [19]

Holcombe et al.

[11] Patent Number: 4,756,269

[45] Date of Patent: Jul. 12, 1988

[54] CABLE FAIRING STACKING RING

[75] Inventors: Robert R. Holcombe, South Kingstown; Benjamin A. Teno, Newport; Steven G. Parks, Middletown, all of R.I.

[73] Assignee: Raytheon Company, Lexington, Mass.

[21] Appl. No.: 846,850

[22] Filed: Apr. 2, 1986

Related U.S. Application Data

[63] Continuation of Ser. No. 537,142, Sep. 29, 1983, abandoned.

[51] Int. Cl.[4] ..... E21B 33/05

[52] U.S. Cl. ..... 114/243; 24/304; 24/122.6

[58] Field of Search ..... 114/243; 308/9 A; 24/304, 122.6

[56] References Cited

U.S. PATENT DOCUMENTS

| | | | |
|---|---|---|---|
| 2,368,415 | 1/1945 | Grant | 308/4 A |
| 2,973,996 | 3/1961 | Self | 308/4 A |
| 3,233,571 | 2/1966 | Rather et al. | 114/243 |
| 3,241,513 | 3/1966 | Rather et al. | 114/243 |
| 3,407,777 | 10/1968 | Anastasio et al. | 114/243 X |
| 3,467,047 | 9/1969 | Chatten et al. | 114/243 |
| 3,612,627 | 10/1971 | Fuller | 308/4 A |
| 3,899,991 | 8/1975 | Chatten et al. | 114/243 |
| 4,474,129 | 10/1984 | Watkins et al. | 114/243 |

*Primary Examiner*—David H. Brown

*Attorney, Agent, or Firm*—Martin M. Santa; Richard M. Sharkansky

[57] ABSTRACT

A stacking ring of elastomeric material for supporting a plurality of fairings is formed by molding the elastomeric material around a cable which has been prepared with a bonding agent to provide a compliant ring capable of supporting substantial loading along the cable axis. Low-friction bearing surfaces may be incorporated in the ends of the ring which also increase the axial force retention capability of the ring.

9 Claims, 1 Drawing Sheet

CABLE FAIRING STACKING RING

This application is a continuation of application Ser. No. 537,142, now abandoned, filed Sept. 29, 1983.

BACKGROUND OF THE INVENTION

This invention relates to stacking rings used to support periodic groups of fairing segments for towed marine systems for sonar, communication, mine sweeping and oceanographic exploration which are normally deployed into the sea and tethered to a moving vessel at speeds ranging from 0 to 50 knots. Quite often when velocities exceed 10 knots, it is necessary to add streamlined fairings to the entire length of tow cable in order to reduce cable strumming (cable vibration) and in order to increase system depth performance by reducing the cable drag.

Performance problems with fairings can occur due to fluid drag force components which act parallel to the cable axis. This axial force is cumulative and can create a force of several thousand pounds on the bottom fairing. Not only can this stacking force crush fairings at the bottom, but also it can cause jamming and distortion of the fairing shape which prevents the fairing from rotating freely in the flow, resulting in poor performance.

The solution to the problem is to fasten a suspension device which transfers the load to the cable at intervals (typically 5–10 feet) down the cable length, instead of allowing the force in each fairing to accumulate, and at the bottom of the cable, to jam the fairings.

Prior solutions have incorporated hard metallic rings which are installed either by compression techniques on pretensioned cables, or by welding the ring seam shut with clearance between the cable, and vulcanizing rubber between the ring and cable to form a bond. Generally the process requires various forms of welding, brazing, cable pretensioning, special tooling and individual testing because of the elasticity and compressibility of tow cables.

Metallic rings have numerous deficiencies: Hard nodes or rings produce concentrated regions of stress which reduce the fatigue life of the cable; metallic rings attached to the cable are larger than the cable and generally slightly larger than the fairing diameter, and passage of the ring through sheaves and winding on storage drums under tension can cause damage to the sheaves and drums; metallic rings are not field-installable or repairable; metallic rings corrode in the sea water/marine environment, and some forms actually accelerate corrosion of the cable itself; metallic rings present poor bearing surfaces for the fairing; metallic rings are relatively expensive; and metallic rings cannot readily adapt to cable diameter changes which occur as a result of cable tensioning and postforming of the cable during use.

SUMMARY OF THE INVENTION

A stacking ring of elastomeric material is formed by molding the elastomeric material around a cable which has been prepared with a bonding agent to provide a compliant ring capable of supporting substantial loading along the cable axis. Low-friction bearing surfaces may be incorporated in the ends of the ring which also increase the axial force retention capability of the ring.

It is the primary object of this invention to provide a stacking ring which does not have the deficiencies of the prior art rings. It is therefore an object to provide a durable, elastic, field-installable, inert, inexpensive and cable-adhering stacking ring.

It is a further object to provide a stacking ring which is easily adaptable to various cable and fairing constructions.

It is a feature of this invention that it is moldable at room temperature and atmospheric pressure.

The basic design of the stacking-ring makes it readily adaptable as a suspension device on tow cables for any application requiring attachment at intermediate points along the cable.

BRIEF DESCRIPTION OF THE DRAWINGS

The objects and features of this invention are explained in the following description taken in conjunction with the accompanying drawings, in which.

DESCRIPTION OF THE PREFERRED EMBODIMENT

Figure 2:
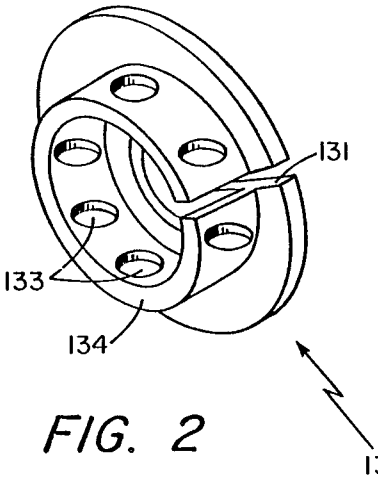
FIG. 2 is an isometric view of the end bearing disk in the stacking ring of FIG. 1.

The stacking ring 10 of this invention is basically a molded, synthetic elastomeric cylinder (e.g. urethane, silicone) which is formulated to cure at room temperature in a simple cavity mold at atmospheric pressure. In order to illustrate the details of the stacking ring more clearly, FIG. 1 shows the stacking ring 10 with a length approximately twice that actually utilized and a thickness about four times the actual thickness of the stacking ring relative to a cable diameter of 1" as shown in the quarter-section view of FIG. 1.

The stacking ring 10 consists of the elastomer 11, surface bonding agent 12 and end bearing discs 13. In an alternate embodiment of the invention the bearing discs 13 are not present. In another alternate embodiment of the stacking ring 10 the bearing disc may be of a material which is capable of being bonded to the elastomer 11, with the possible utilization of a bonding agent to improve the bond between the elastomer 11 and the disc 13. Bearing materials which are difficult to bond, such as disclosed in this preferred embodiment, will utilize mechanical linking of the elastomer 11 with the ring 13.

Figure 1:
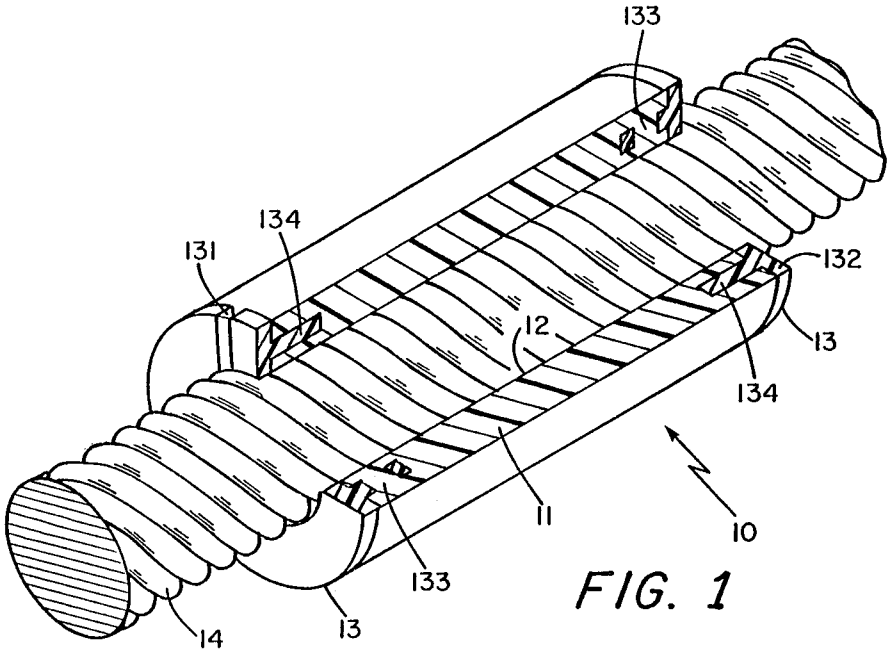
FIG. 1 is a isometric quarter-section view of the stacking ring of the invention.

Functionally the stacking ring 10 of FIG. 1 performs the same general purpose as the prior art metallic stacking rings. That is, it prevents fairings from sliding axially along the cable 14 and its periodic placement along the length of the cable 14 prevents the accumulation of stacking forces on the bottom fairing which would otherwise be of such magnitude as to distort the fairing and prevent its free rotation about the cable as is necessary for proper operation. The stacking ring design of this invention represents a significant improvement over the prior art stacking ring design in that the problems applicable to metallic stacking rings presented earlier in this application have been overcome.

The stacking ring 10 is fabricated by priming that portion of the cable 14 to which the ring is to be bonded with an elastomer bonding agent. For a stainless steel cable 14 it was found that the commercially available epoxy primer, DEVOE 201, provided a satisfactory bond between the cable and the polyurethane elastomer. Two low friction bearing discs 13 shown in detail in FIG. 2 are snapped over the cable 14 by twisting open the disc 13 at its split line 131. If the disc 13 is not to be used, the previous step may be omitted. A conventional split mold (not shown) is secured around the cable 14 with the discs 13 within each end of the mold. The mold is so configured that whether or not the disc 13 is used there is a sufficiently tight seal at the ends of the mold to prevent the elastomer compound which is next injected into the mold from leaking out of the mold. A commercially available polyurethane elastomer, Conap EN-8, has been found to have the characteristic properties desirable in this application, namely bonding capability to the cable 14, elasticity, and sufficient strength to withstand the axial component of force provided by the fairings which it is restraining. The elastomer is allowed to cure. Cure times are typically three to seven days at normal ambient temperatures. As little as twelve hours are required if elevated temperatures are used.

The split bushings or bearing discs 13 in the end of each stacking ring 10 are designed to provide low friction surfaces for each fairing group or suspended device to rotate against while supporting the axial load. Free rotation is a necessary requirement for proper fairing performance. The bearing disc 13 has a T-shaped cross-section 132 with captivating holes 133 contained in the leg 134 of the "T". The hole 133 is encapsulated in the elastomer 11 as shown in FIG. 1. The holes 133 lock the bearing disc 13 in place and distribute the stacking load within the stacking ring 10 to increase the bearing capacity of ring 10 and to resist peeling of the ring from the cable.

Figure 3:
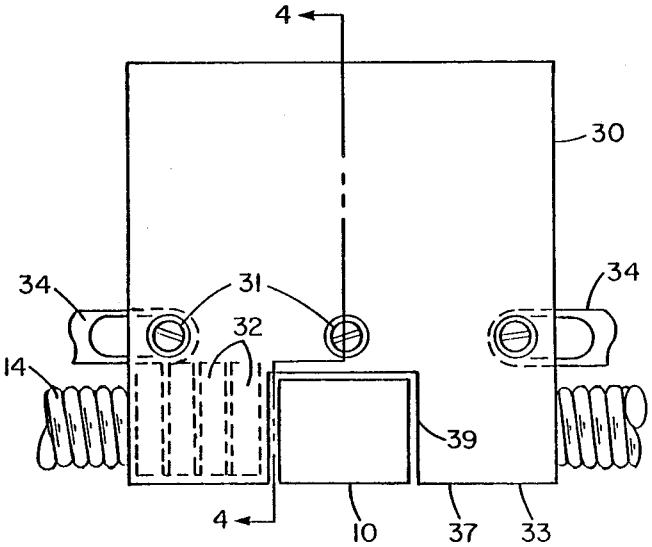
FIG. 3 is a plan view of a fairing segment with a cut-out section in which a stacking ring is positioned.
Figure 4:
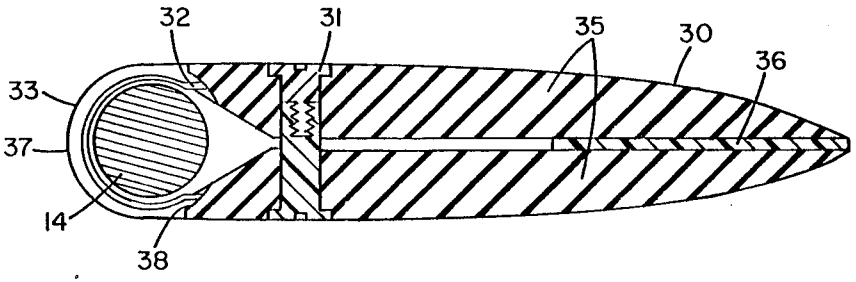
FIG. 4 is a cross-sectional view of FIG. 3 along section line 4—4.

A stacking ring having a 1.25 inch diameter and 1.75 inch length bonded to a 1" diameter cable 14 when tested in a laboratory tensile test had a capacity exceeding 800 to 1300 pounds and thus is easily capable of withstanding the maximum axial stress imposed upon a stacking ring 10 when spaced at 10-foot intervals thereby supporting twenty fairing segments each six inches in length such as shown in FIGS. 3 and 4. The elastomer material employed in the stacking ring 10 is noncorrosive and significantly softer than the cable 14, thus eliminating a source of fatigue stress in the cable. The compliance of the stacking ring 10 does not cause any damage to the sheaves, cable drum or other apparatus used to deploy the cable. The design and material selection of the stacking ring 10 allows field retrofit or repair at any point on the cable without expensive tooling and methods. The materials selected are inherently inexpensive. Because the stacking ring 10 is constructed of an elastomer material which is bonded to the cable, the ring 10 has the ability to adapt to cable diameter changes produced by changes in stress on the cable.

The use of low friction bearing discs or bushings 13 at the ends of the stacking ring is an additional novel feature. The material selected in a preferred embodiment of the invention for the low friction bushing 13 is DELRIN which has the attributes of being a low friction material which can be factory fabricated by injection molding prior to molding the stacking ring 10 and which has sufficient flexibility when slotted as by slot 131 of FIG. 2 to be twisted and slipped onto the cable 14. Since chemical bonding to DELRIN is difficult, the T-shaped disc 13 design of FIGS. 1 and 2 has locking holes 133 which allows the disc 13 to be mechanically locked to the elastomer 11 of stacking ring 10 to not only produce a low friction surface at the end of the stacking ring, but also to distribute the load produced by the stacked fairings within the molded ring.

Field installation and repair capabilities of the stacking ring of this invention contribute greatly to its desirability.

FIG. 3 illustrates how the stacking ring of this invention may be used with a particular form of fairing 30. However, the invention is not limited to being used with only this particular type of fairing, but may, for example, also be used with an appropriately modified or even unmodified fairing of the type described in U.S. Pat. No. 3,611,976 or other fairings.

Referring again to FIG. 3, there is shown a top plan view of a fairing 30. After the stacking ring 10 has been bonded to the cable 14, the fairing 30 tail halves 35, shown in cross-section in FIG. 3, are slipped over the cable and stacking ring. The fairing 30 has the central region of the nose portion 33 cut away in order to accommodate the stacking ring 10. The cutout portion 39 of the nose 33 of the fairing is only slightly larger than the corresponding dimensions of the stacking ring. The forward portion 37 of the nose 33 has the same radius as the stacking ring 10, but the rear portion 38 of the cutout has a slightly larger radius in order to provide clearance for rotation of the fairing about the ring while providing only small clearance in order to reduce turbulence effects. Although not preferred, the cutout 39 may alternatively be at the end of a fairing. If the increased drag and turbulence can be tolerated, then ring 10 may be placed between fairings without a cutout nose portion.

The fairing is held together with fasteners 31 and contains a flexible spring-steel clip 32 in the nose portion 33 of the fairing 30. The steel clip is in contact with the cable 14 and allows the fairing 30 to freely rotate around the cable. The links 34 attach the fairing 30 to its adjacent fairings. A sectional view along section line 4—4 of the fairing 30 is shown in FIG. 4. The fasteners 31 are seen to fasten together the two tail halves 35 of the fairing. The edges of the tail halves of the fairing are glued to a stiffener plate 36. The spring steel clips 32 are shown surrounding and of slightly larger diameter than the cable 14.

Having described a preferred embodiment of the invention, it will now be apparent to one of skill in the art that other embodiments incorporating its concept may be used. It is felt, therefore, that this invention should not be limited to the disclosed embodiment, but rather should be limited only by the spirit and scope of the appended claims.

What is claimed is:

1. A stacking ring for supporting a cable fairing on a cable, said stacking ring comprising:

a continuous formed polyurethane elastomer cylinder on said cable;

bonding means for securing said cylinder to said cable;

said elastomer cylinder having a bearing disc of plastic material rigidly attached at one end of said cylinder;

said disc being harder than said elastomer cylinder and adapted to make sliding contact with said fairing.

2. The stacking ring of claim 1 wherein:

said bearing disc is a low friction material.

3. The stacking ring of claim 1 wherein said bonding means is a bonding material between said elastomer cylinder and said cable.

4. The stacking ring of claim 3 wherein:

said bonding material is an epoxy primer.

5. The stacking ring of claim 1 further comprising:

said bearing disc being bonded to said elastomeric cylinder.

6. The stacking ring of claim 5 comprising in addition:

said bearing disc having holes therein;

said elastomeric cylinder having a portion of its elastomeric within said holes to provide a mechanical bond to said bearing disc.

7. The stacking ring of claim 5 comprising in addition:

said bearing disc having a radial slit and being sufficiently flexible to allow said disc to be placed around said cable.

8. The stacking ring of claim 5 comprising in addition:

said bearing disc being "T" shaped to have a top and a leg, the top said "T" shape forming the bearing surface for said cylinder end;

said bearing disc having at least one hole in the leg of said "T" to provide a mechanical bond to the elastomer of said bearing disc.

9. The stacking ring of claim 8 comprising in addition said bearing disc having a radial slit and being sufficiently flexible to allow said disc to be placed around said cable.

* * * * *